US011545111B2

(12) United States Patent
Liu et al.

(10) Patent No.: US 11,545,111 B2
(45) Date of Patent: Jan. 3, 2023

(54) SIGNAL TRANSMISSION DEVICE AND RELATED METHOD

(71) Applicant: Realtek Semiconductor Corp., HsinChu (TW)

(72) Inventors: Wei-Chieh Liu, HsinChu (TW); Po-Hsien Wu, HsinChu (TW); Huan-Wen Chen, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 17/472,543

(22) Filed: Sep. 10, 2021

(65) Prior Publication Data

US 2022/0093061 A1 Mar. 24, 2022

Related U.S. Application Data

(60) Provisional application No. 63/082,477, filed on Sep. 24, 2020.

(30) Foreign Application Priority Data

Aug. 6, 2021 (TW) ..... 110129151

(51) Int. Cl.

| | |
|---|---|
| ***G09G 5/12*** | (2006.01) |
| ***G09G 3/36*** | (2006.01) |
| ***G09G 3/34*** | (2006.01) |

(52) U.S. Cl.

CPC ..... *G09G 5/12* (2013.01); *G09G 3/3406* (2013.01); *G09G 3/3685* (2013.01); *G09G 2310/08* (2013.01); *G09G 2340/16* (2013.01)

(58) Field of Classification Search

CPC ..... G09G 2310/08; G09G 2340/16

See application file for complete search history.

(56) References Cited

U.S. PATENT DOCUMENTS

| | | | | |
|---|---|---|---|---|
| 2002/0093590 | A1* | 7/2002 | Hodgkiss | H04N 5/073 348/E5.014 |
| 2012/0154454 | A1* | 6/2012 | Ohishi | G09G 3/342 345/99 |
| 2017/0084228 | A1* | 3/2017 | Kwak | G09G 3/20 |

FOREIGN PATENT DOCUMENTS

CN 102968974 A 3/2013

* cited by examiner

*Primary Examiner* — Van N Chow

(74) *Attorney, Agent, or Firm* — Winston Hsu

(57) ABSTRACT

A signal transmission device includes a first master signal conversion circuit and at least one first slave signal conversion circuit. The first master signal conversion circuit is configured to receive first partial data of output data from a data generation unit, convert the first partial data of the output data into a first transmission signal correspondingly, and output a first synchronization signal. The at least one first slave signal conversion circuit is configured to receive at least second partial data of the output data and convert the at least second partial data of the output data into at least one second transmission signal correspondingly, wherein the at least one first slave signal conversion circuit controls a timing of the at least one second transmission signal according to the first synchronization signal.

12 Claims, 4 Drawing Sheets

SIGNAL TRANSMISSION DEVICE AND RELATED METHOD

CROSS REFERENCE TO RELATED APPLICATIONS

This application claims the priority of U.S. Provisional Application Ser. No. 63/082,477 filed on 2020 Sep. 24, the disclosure of which is incorporated herein by reference.

BACKGROUND OF THE INVENTION

1. Field of the Invention

The present invention relates to display systems, and more particularly to a signal transmission device and related method for use in a display system.

2. Description of the Prior Art

In display systems, horizontal synchronization signals (Horizontal Sync or Hsync) and vertical synchronization signals (Vertical Sync or Vsync) are generally employed for timing alignment between circuits. Typically, an image generation unit will issue a Hsync signal after pixel data corresponding to an entire row of an image has been sent, while issue a Vsync signal after pixel data corresponding to an entire image has been sent. A display panel driver can control timing of driving a display panel based on these synchronization signals. In a display system with high resolution and high color depth, pixel data of an image will be transmitted from the image generation unit to the display panel driver through multiple sets of transmitter and receivers in order to meet requirements of transmission speed. As there may be synchronization issues between each set of the transmitter and the receiver, a frame buffer is provided to the display panel driver to store the pixel data temporarily. When the timings are aligned, the display panel is driven. However, in some cases, the signal transmission interface has special requirements for the timing of the Hsync signal, which causes the timing of the Vsync signal to drift. In view of this, a large-size frame buffer of such display system is required to avoid overflow.

SUMMARY OF THE INVENTION

In view of above, it is one object of the present invention to provide a signal transmission architecture that significantly reduces the size of the frame buffer. A display system of the present invention comprises multiple sets of signal conversion circuits at an image generation end. An image is transmitted through different lanes provided by these signal conversion circuits, to a display panel end. In the present invention, one of the multiple signal conversion circuits is configured as a master device, while the others are configured as slave devices. The master device could issue a synchronization signal such that timings of the slave devices are aligned with the timing of the master device. Since synchronization at the transmitting end is dominated by the master device, it prevents the signal timing of the master device from lagging behind the signal timings of the slave devices. In this way, degrees of timing errors between the master and slave devices are limited, and the requirement on the size of the frame buffer is alleviated. Also, hardware cost of the display system and sizes of some circuits (such as a display panel driver) are also reduced.

According to one embodiment of the present invention, a signal transmission device is provided. The signal transmission device comprises: a first master signal conversion circuit and at least one first slave signal conversion circuit. The first master signal conversion circuit is configured to receive first partial data of output data from a data generation unit, accordingly convert the first partial data of the output data into a first transmission signal correspondingly, and output a first synchronization signal. The at least one first slave signal conversion circuit is configured to receive at least second partial data of the output data and accordingly convert the at least second partial data of the output data into at least one second transmission signal correspondingly, wherein the at least one first slave signal conversion circuit controls a timing of the at least one second transmission signal according to the first synchronization signal.

According to one embodiment of the present invention, a signal transmission method is provided. The signal transmission method comprises: receiving first partial data of output data, accordingly converting the first partial data of the output data into a first transmission signal correspondingly, and outputting a first synchronization signal; receiving at least second partial data of the output data and accordingly converting the at least second partial data of the output data into at least one second transmission signal correspondingly; and controlling a timing of the at least one second transmission signal in accordance with the first synchronization signal.

These and other objectives of the present invention will no doubt become obvious to those of ordinary skill in the art after reading the following detailed description of the preferred embodiment that is illustrated in the various figures and drawings.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Reference throughout this specification to "one embodiment" or "an embodiment" means that a particular feature, structure or characteristic described in connection with the embodiment or example is included in at least one embodiment of the present embodiments. Thus, appearances of the phrases "in one embodiment" or "in an embodiment" in various places throughout this specification are not necessarily all referring to the same embodiment. Furthermore, the particular features, structures or characteristics may be combined in any suitable combinations and/or sub-combinations in one or more embodiments.

In the following descriptions, signal transmission devices of the present invention will be described as being applicable to display systems in multiple embodiments. In such embodiments, an image generation unit of a display system transmits generated video contents to a display panel for displaying. The signal transmission device of the present invention can be used during transmission of video signals, and effectively reduce the requirement on a frame buffer. It is noted that in addition to the above applications, the signal transmission device of the present invention is also applicable to other types of systems to transmit various types of data generated by various types of data generation units.

Figure 1:
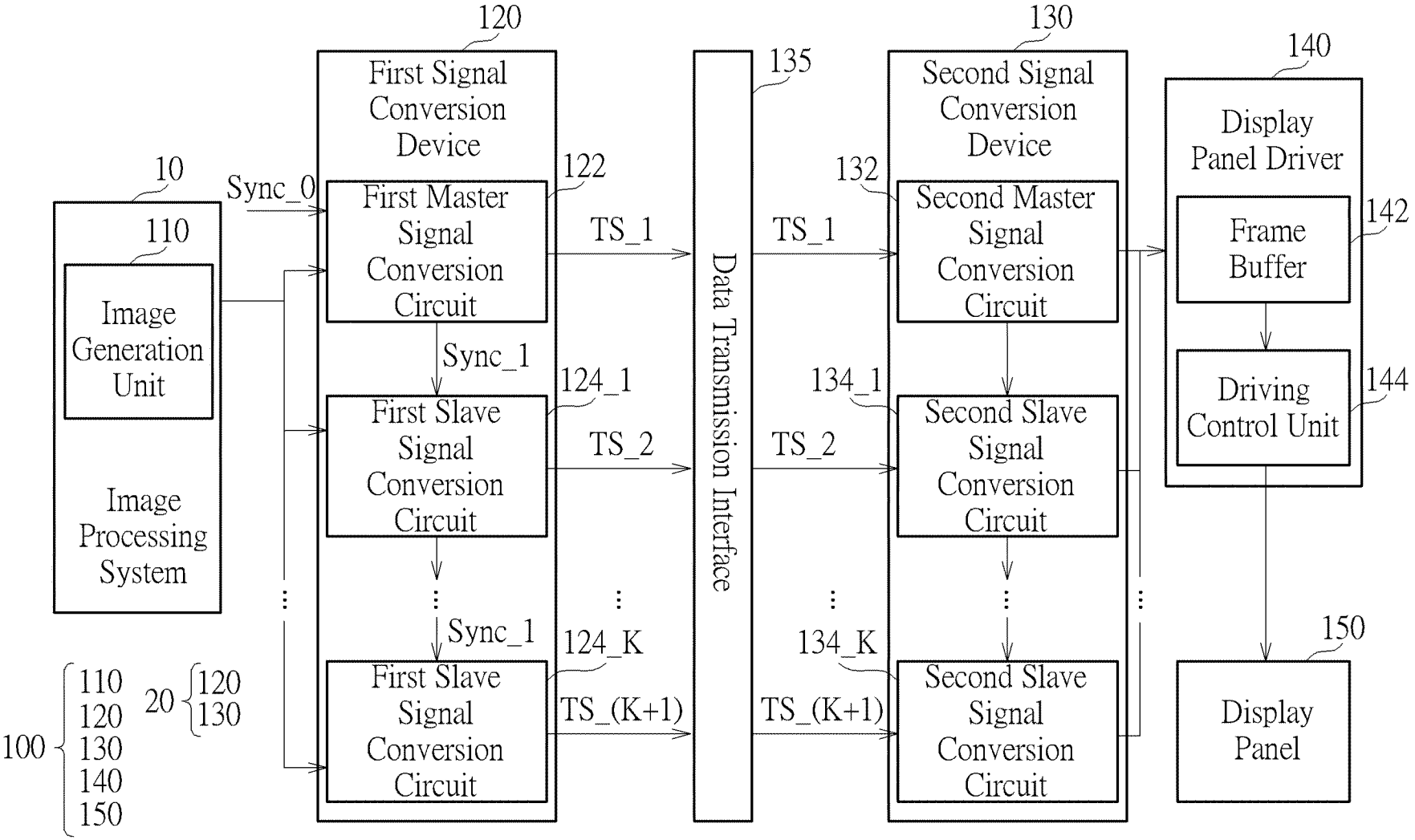
FIG. 1 is a schematic diagram of a signal transmission device and a related display system according to one embodiment of the present invention.

Referring to FIG. 1, a schematic diagram of a signal transmission device and a related display system is illustrated according to an embodiment of the present invention. As illustrated, a display system 100 comprises an image generation unit 110, a first signal conversion device 120, a second signal conversion device 130, a display panel driver 140, and a display panel 150. The image generation unit 110 may include (but not limited to): a graphics processor, which is further disposed in an image processing system 10. The image processing system 10 can receive and process different media sources to generate video and audio content. The image generation unit 110 is configured to generate the video content according to the media source, and provide the video content to the display panel 150 for displaying.

The signal processing device 20 of the present invention comprises the first signal conversion device 120 and the second signal conversion device 130. The first signal conversion device 120 includes a first master signal conversion circuit 122 and one or more first slave signal conversion circuits 124_1-124_K. The image generation unit 110 divides a generated image into different parts, and transmits pixel data of different parts to the first master signal conversion circuit 122 and the first slave signal conversion circuits 124_1-124_K through multiple lanes. In one embodiment, the image generation unit 110 may send data corresponding to the left half of an image to the first master signal conversion circuit 122, and send data corresponding to the right half of the image to the first slave signal conversion circuit 124_1. However, this is just for illustrative purpose only. The first master signal conversion circuit 122 and the first slave signal conversion circuits 124_1-124_K are configured to convert the pixel data of different parts of the image into a signal format compliant with a standard that a data transmission interface 135 is defined by, and through the data transmission interface 135, data is transmitted to the second signal conversion device 130. Specially, the first signal conversion device 120 is configured to convert the signal of each lane into a transmission signal compliant with the standard that the data transmission interface 135 is defined by, and transmits the data to the second signal conversion device 130 through the data transmission interface 135. In an alternative embodiment, the image generation unit 110 outputs the pixel data of the image to the first signal conversion device 120 based on the V-by-One HS standard, and the first signal conversion device 120 may convert the pixel data into transmission signals TS_1-TS_(K+1) compliant with the High Definition Multimedia Interface (HDMI) standard. The transmission signals TS_1-TS_(K+1) are transmitted through the data transmission interface 135 to the second signal conversion device 130. However, this is not a limitation of the present invention. In various embodiments of the present invention, the image generation unit 110 may use a signal format different from the V-by-One HS standard to transmit the pixel data to the first signal conversion device 120. The first signal conversion device 120 may also convert the pixel data into a signal format different from the HDMI standard.

When the first master signal conversion circuit 122 and the first slave signal conversion circuits 124_1-124_K perform respective signal conversions, the first master signal conversion circuit 122 controls signal timings therebetween. According to a synchronization signal Sync_0 outputted by the image generation unit 110, the first master signal conversion circuit 122 generates a synchronization signal Sync_1 which is used by itself to control a timing of the transmission signal TS_1. In addition, the first master signal conversion circuit 122 also transmits the synchronization signal Sync_1 to the first slave signal conversion circuits 124_1-124_K. Accordingly, the first slave signal conversion circuits 124_1-124_K generate respective synchronization signals according to the synchronization signal Sync 1, thereby controlling timings of the transmission signals TS_2-TS_(K+1). In one embodiment, the synchronization signal Sync_1 is a vertical synchronization signal (i.e., Vertical Sync or Vsync).

The second signal conversion device 130 includes a second master signal conversion circuit 132 and one or more second slave signal conversion circuits 134_1-134_K. The second master signal conversion circuit 132 and the second slave signal conversion circuits 134_1-134_K are configured to convert the transmission signals TS_1-TS_(K+1) received from the data transmission interface 135 into a signal format that can be recognized by the display panel driver 140. The signal format is consistent with the signal format used by the image generation unit 110 to output the pixel data to the first signal conversion device 120. In one embodiment, the second signal conversion device 130 may convert the transmission signals TS_1-TS_(K+1) from the signal format defined by the HDMI standard to the signal format defined by the V-by-One HS standard.

Moreover, the second master signal conversion circuit 132 and the second slave signal conversion circuits 134_1-134_K are respectively configured to convert signals on different lanes to pixel data, and the generated pixel data can be written to a frame buffer 142 of the display panel driver 140. The pixel data generated by the second master signal conversion circuit 132 and the second slave signal conversion circuits 134_1-134_K respectively include different parts of an entire image outputted by the image generation unit 110. Before reading out a row of pixel data and accordingly driving the display panel 150, a driving control unit 144 of the display panel driver 140 waits until an entire row of pixel data has been written into the frame buffer 142.

Figure 2:
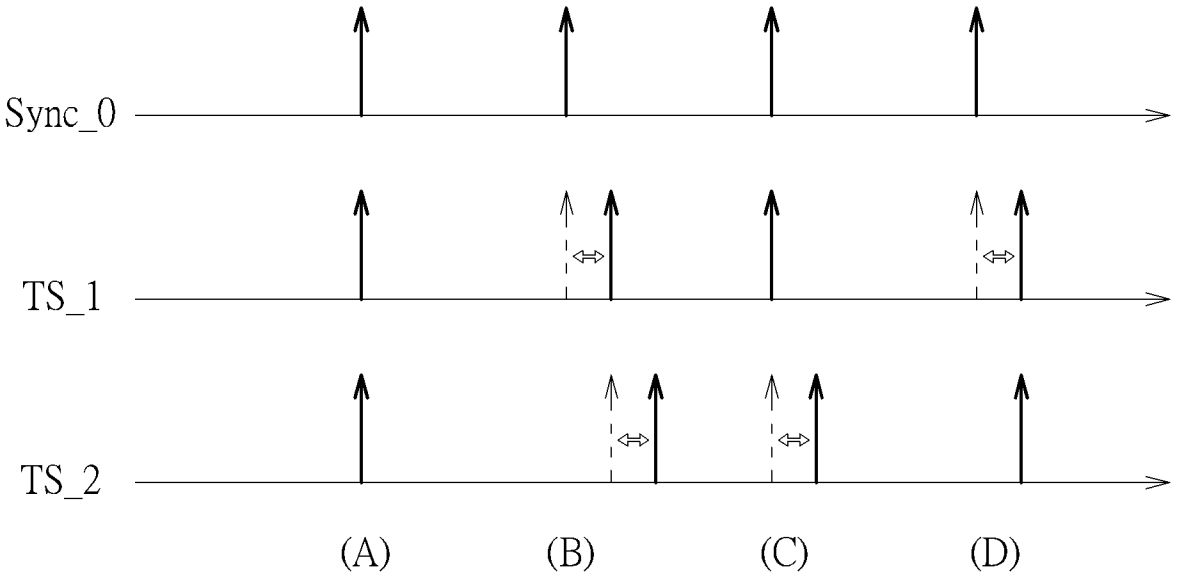
FIG. 2 is a signal timing diagram inside a signal transmission device according to one embodiment of the present invention.

Referring to FIG. 1 and FIG. 2 for understanding the utility of the signal transmission device of the present invention, FIG. 2 illustrates timing errors between the synchronization signal Sync_0 of the image generation unit 110, the transmission signal TS_1 of the first master signal conversion circuit 122, and the transmission signal TS_2 of the first slave signal conversion circuit 124_1. In a first case (A), the transmission signal TS_1 is aligned with the synchronization signal Sync_0 in their timings, and the transmission signal TS_2 is aligned with the transmission signal TS_1 in timing. In the second case (B), the transmission signal TS_1 lags behind the synchronization signal Sync_0, and the transmission signal TS_2 lags behind the transmission signal TS_1. In the third case (C), the transmission signal TS_1 is aligned with the synchronization signal Sync_0 in timing, and the transmission signal TS_2 lags behind the transmission signal TS_1. In the fourth case (D), the transmission signal TS_1 lags behind the synchronization signal Sync_0, and the transmission signal TS_2 is aligned with the transmission signal TS_1. It can be further understood from the above descriptions that under the architecture of the present invention, timings of the transmission signals TS_2-TS_(K+1) from the first slave signal conversion circuits 124_1-124_K may lag behind the transmission signal TS_1 of the first master signal conversion circuit 122 or aligned with the transmission signal TS_1 in timing. This is because timings of the first slave signal conversion circuits 124_1-124_K depend on the synchronization signal Sync_1 generated by the first master signal conversion circuit 122. Timings of the transmission signals TS_2-TS_(K+1) are by no means ahead of the first transmission signal TS_1 of the first master signal conversion circuit 122. Such synchronization control effectively reduces degrees of timing errors between different signal conversion circuits, and therefore can reduce the requirement on the size of the frame buffer 142.

Figure 3:
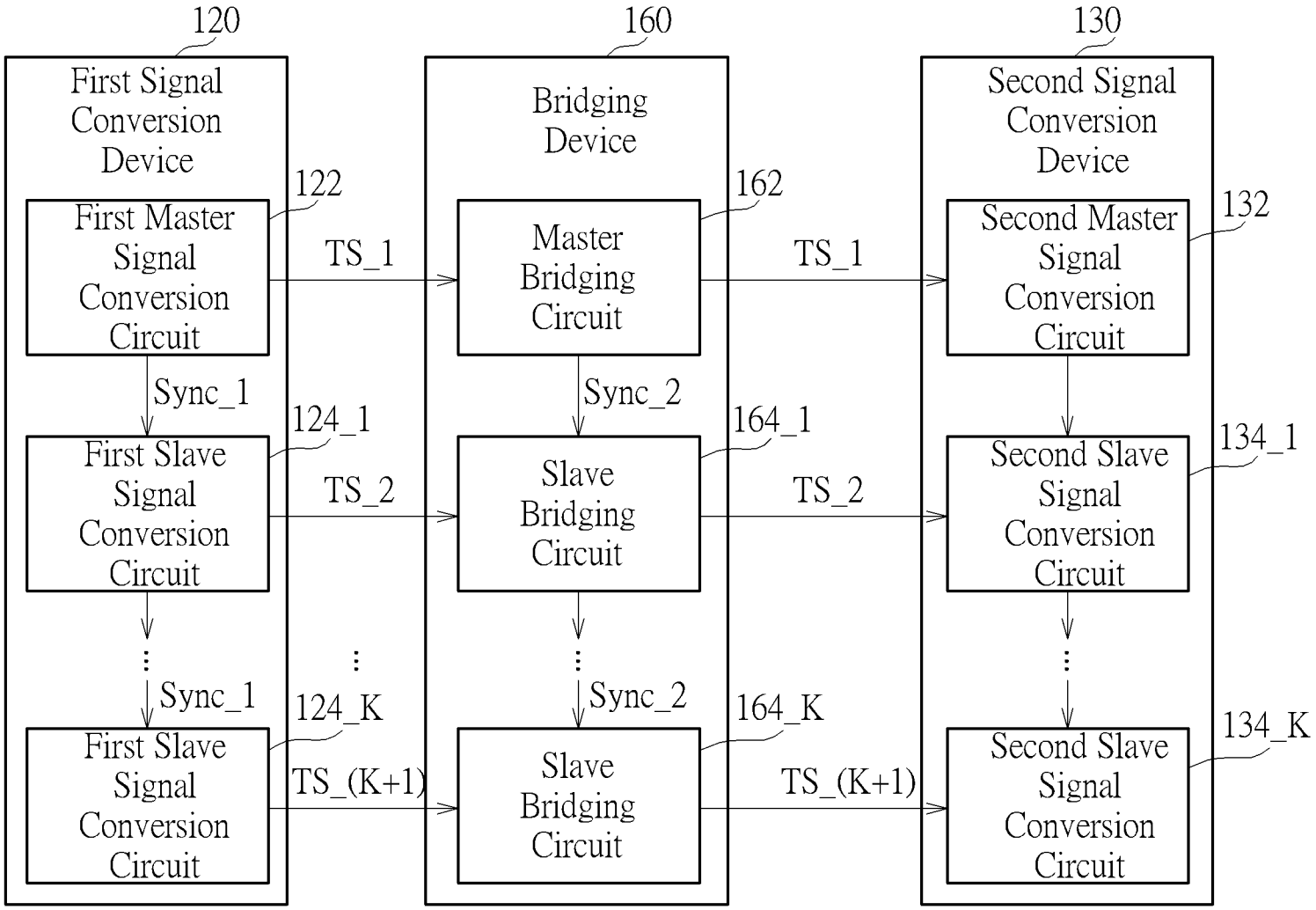
FIG. 3 is a schematic diagram of a signal transmission device according to another embodiment of the present invention.

In one embodiment, considering that the display system 100 of FIG. 1 may have a separated design, a physical distance between the image processing system 10 and the display panel 150 may be considerably long. Thus, the signal processing device 20 of the present may be provided with a bridging device for extending/repeating transmitting signals TS_1-TS_(K+1). Referring to FIG. 3 for further details, a bridging device 160 is used to extend/repeat the transmission signals TS_1-TS_(K+1) transmitted between the first signal conversion device 120 and the second signal conversion device 130. The bridging device 160 includes a master bridging circuit 162 and one or more slave bridging circuits 164_1 to 164_K. In this embodiment, in order to avoid increasing the degrees of the timing errors between the transmission signals TS_1-TS_(K+1), while extending the signals through the master bridging circuit 162 and the slave bridging circuits 164_1-164_K, the master bridging circuit 162 issues a synchronization signal Sync_2 that is used by itself to the slave bridging circuits 164_1-164_K. The slave bridging circuits 164_1-164_K control the timings of the transmission signals TS_1-TS_(K+1) according to the synchronization signal Sync_2. With such timing relationship, even if the bridging device 160 causes asynchrony, it can only cause the timings of the transmission signal TS_2-TS_(K+1) to lag behind the transmission signal TS_1, but not to be ahead of the transmission signal TS_1. Although the bridging device 160 is required to be attached to the signal processing device 20, it can ensure that the size of the frame buffer 142 will not be excessively increased.

Figure 4:
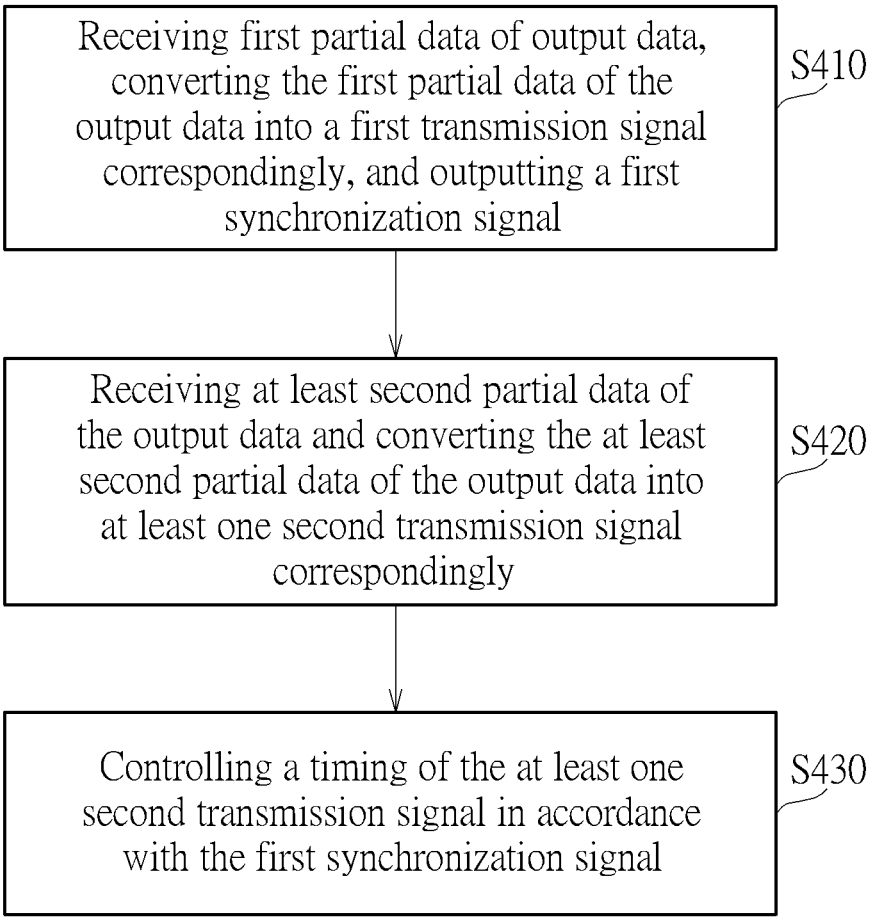
FIG. 4 is a flow chart of a signal transmission method according to one embodiment of the present invention.

FIG. 4 illustrates a simplified flow chart of a method for timing synchronization in a multi-lane signal transmission device in the aforementioned embodiments. The flow includes the following steps:

Step S410: first partial data of output data is received, the first partial data of the output data is converted into a first transmission signal correspondingly, and a first synchronization signal is outputted;

Step S420: at least second partial data of the output data is received and the at least second partial data of the output data is converted into at least one second transmission signal correspondingly; and Step S430: a timing of the at least one second transmission signal is controlled in accordance with the first synchronization signal.

Since the principles and operation details of the aforementioned steps have been clearly explained in the previous embodiments, no further descriptions are made here for sake of brevity. It is noted that in certain embodiments of the present invention, it is possible to add extra steps based on known techniques in the art, thereby to improve the overall effect of the present invention.

It is note that although in the above descriptions, the signal transmission device of the present invention is applied to a display system, those skilled in the art should understand that the signal transmission device of the present invention is applicable to various multi-lane data transmissions. By setting the master-slave relationship among the transmitting circuits (such as the first master/slave signal conversion device or master/slave bridging circuit), the degree of timing errors can be reduced. In view of this, the requirement on the frame buffer can be alleviated, and the hardware cost and the circuit area can be reduced as well.

Embodiments of the present invention can be implemented using hardware, software, firmware, and/or combinations thereof. Through an appropriate instruction execution system, embodiments of the present invention can be implemented using software or firmware stored in a memory. In terms of hardware, embodiments of the present invention can be implemented using any of the following technologies or a combination thereof: a separate logic having a logic gate capable of performing a logic function according to a data signal, and an application specific integrated circuit (ASIC), a programmable gate array (PGA), or a field programmable gate array (FPGA) having suitable combinational logics.

Flowcharts and block diagrams in the flow diagrams illustrate the architecture, functionality, and operation of possible implementations of systems, methods, and computer program products according to various embodiments of the present embodiments. In this regard, each block in the flowchart or block diagrams may represent a module, segment, or portion of code, which comprises one or more executable instructions for implementing the specified logical function(s). It is also noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A signal transmission device, comprising:

a first master signal conversion circuit, configured to receive first partial data of output data from a data generation unit, convert the first partial data of the output data into a first transmission signal correspondingly, and output a first synchronization signal to at least one first slave signal conversion circuit; and the at least one first slave signal conversion circuit, configured to:

receive the first synchronization signal and at least second partial data of the output data;

convert the at least second partial data of the output data into at least one second transmission signal correspondingly; and generate at least one synchronization signal according to the first synchronization signal, wherein the at least one first slave signal conversion circuit controls a timing of the at least one second transmission signal according to the at least one synchronization signal.

2. The signal transmission device of claim 1, further comprising:

a second master signal conversion circuit, coupled to the first master signal conversion circuit, configured to receive the first transmission signal, convert the first transmission signal into the first partial data correspondingly, and output the first partial data to a buffer; and at least one second slave signal conversion circuit, coupled to the first slave signal conversion circuit, configured to receive the at least one second transmission signal, convert the at least one second transmission signal into the at least second partial data correspondingly, and output the at least second partial data to the buffer.

3. The signal transmission device of claim 2, wherein the signal transmission device is applicable to a display system, the data generation unit is an image generation unit of the display system, the output data is pixel data of an image, and the buffer is a frame buffer of the display system; a driver of the display system is operable to drive a display panel according to the pixel data of the image buffered in the frame buffer.

4. The signal transmission device of claim 3, wherein the first partial data corresponds to a first portion of pixel data of the image, and the at least second partial data corresponds to at least one second portion of the pixel data of the image.

5. The signal transmission device of claim 2, further comprising:

a master bridging circuit, coupled between the first master signal conversion circuit and the second master signal conversion circuit, configured to extend/repeat the first transmission signal and accordingly generate a second synchronization signal; and at least one slave bridging circuit, coupled between the at least one first slave signal conversion circuit and the at least one second slave signal conversion circuit, configured to extend/repeat the at least one second transmission signal and control a timing of the at least one second transmission signal according to the second synchronization signal.

6. The signal transmission device of claim 1, wherein the first synchronization signal is a vertical synchronization (Vsync) signal.

7. A signal transmission method, comprising:

receiving first partial data of output data, converting the first partial data of the output data into a first transmission signal correspondingly, and outputting a first synchronization signal;

receiving at least second partial data of the output data and converting the at least second partial data of the output data into at least one second transmission signal correspondingly; and generating at least one synchronization signal according to the first synchronization signal, and controlling a timing of the at least one second transmission signal in accordance with the at least one synchronization signal.

8. The signal transmission method of claim 7, further comprising:

receiving the first transmission signal, converting the first transmission signal into the first partial data correspondingly, and outputting the first partial data to a buffer; and receiving the at least one second transmission signal, converting the at least one second transmission signal into the at least second partial data correspondingly, and outputting the at least second partial data to the buffer.

9. The signal transmission method of claim 8, wherein the signal transmission method is applicable to a display system, the output data is pixel data of an image generated by an image generation unit of the display system, and the buffer is a frame buffer of the display system; a driver of the display system is operable to drive a display panel according to the pixel data of the image buffered in the frame buffer.

10. The signal transmission method of claim 9, wherein the first partial data corresponds to a first portion of pixel data of the image, and the at least second partial data corresponds to at least one second portion of the pixel data of the image.

11. The signal transmission method of claim 8, further comprising:

extending/repeating the first transmission signal and accordingly generating a second synchronization signal; and extending/repeating the at least one second transmission signal and controlling a timing of the at least one second transmission signal according to the second synchronization signal.

12. The signal transmission method of claim 7, wherein the first synchronization signal is a vertical synchronization (Vsync) signal.

* * * * *